United States Patent [19]

Uhlig et al.

[11] 4,220,262

[45] Sep. 2, 1980

[54] SAFETY CLOSURE

[75] Inventors: Albert R. Uhlig; Thomas J. Krall, both of Toledo, Ohio

[73] Assignee: Owens-Illinois, Inc., Toledo, Ohio

[21] Appl. No.: 68,037

[22] Filed: Aug. 20, 1979

[51] Int. Cl.[2] ..... B67D 5/32

[52] U.S. Cl. ..... 222/153; 215/211; 215/301; 220/281; 222/556

[58] Field of Search ..... 215/211, 213, 224, 225, 215/305, 306, 301; 220/281; 222/153, 556

[56] References Cited

U.S. PATENT DOCUMENTS

| | | | |
|---|---|---|---|
| 4,022,352 | 5/1977 | Pehr | 222/153 |
| 4,047,495 | 9/1977 | O'Brian | 215/224 |
| 4,127,221 | 11/1978 | Vere | 222/153 |
| 4,170,315 | 10/1979 | Dubach et al. | 220/281 |

*Primary Examiner*—George T. Hall

*Attorney, Agent, or Firm*—John R. Nelson; Myron E. Click; David H. Wilson

[57] ABSTRACT

An improved safety closure for containers of harmful products includes an inverted cup-shaped body member formed of resilient plastic material and an integrally molded locking flap connected by an integral hinge to the top periphery of the body member. The locking flap folds into a conforming recess in the top surface or panel of the body portion, and, in its folded position, all edges of the locking flap are flush with the adjacent surface of the panel. One or more dispensing openings are provided in the panel and sealing means are provided on the bottom of the flap to close the dispensing openings in the folded position of the locking flap. Two distinct sets of cooperating locking surfaces are provided on the flap and body portion to retain the locking flap in its folded position. The one set requires a vertically downward pressure on a specific area on the panel to release. The second set of latching surfaces can then be released by manual inward depression of a segment of the annular wall of the body member. Such concurrent application of a downward force and a compressing force on the closure effects an elevation of the free edge of the locking flap above the conforming recess to permit the locking flap to be manually lifted to a fully opened position.

4 Claims, 5 Drawing Figures

SAFETY CLOSURE

BACKGROUND OF THE INVENTION

This invention relates to safety closures for necked containers, and more particularly, to improved safety closures of the type having an integral flap that is normally flush mounted and locked in a depression in the top surface or panel of the closure. Such locking flap carries means on its underside for sealingly engaging one or more dispensing openings provided in the top or panel portion of the closure.

There has been a number of disclosures in the prior are of so-called child resistant or safety closures for necked containers which have utilized a closure body portion and an integrally molded, hinged locking flap portion cooperating with the body portion to effect the closing of one or more dispensing openings in the body portion. Typical of such prior art disclosures are U.S. Pat. No. 3,845,872 to Townes; U.S. Pat. No. 3,927,805 to Stull; and U.S. Pat. No. 4,022,352 to Pehr. The alleged safety feature found in each of these prior art safety closure constructions is the necessity for the application by the finger of a significant downward force to a specific location on the top wall or panel of the closure. It has been recognized, however, that this type of actuation may be inadvertently applied by a child through the simple expedient of banging the container with the closure attached against a hard surface in such manner that a downward opening force of the proper magnitude is applied to the proper spot of the safety closure. The possibility of such inadvertent opening of the closure by children significantly limits the usefulness of such prior art safety closure constructions.

In the co-pending application, Ser. No. 044,871, filed June 1, 1979, (case No. 14,461) which is assigned to the Assignee of this application, there is disclosed and claimed a safety closure construction wherein a segment of the annular wall of the closure is depressible by a compression action of the fingers to effect the release of cooperating latching surfaces holding the locking flap in closed position. This construction requires not only the application of a compression force by the fingers but the concurrent application of a lifting force on the free end of the locking flap to effect the opening of the closure. There still remains the possibility, although a much smaller possibility, that a child could inadvertently effect the opening of such closure.

SUMMARY OF THE INVENTION

In accordance with this invention, a safety closure is provided of the type having a molded plastic inverted cup-shaped body portion connected by an integral hinge to a foldable locking flap, the locking flap being foldable into appropriate recess provided in the top or panel of the body portion so that the edges of the locking flap are flush with the adjacent panel surfaces and inaccessible for actuation of the flap by the fingernail. In its closed, folded position, sealing means on the locking flap cooperate with one or more openings provided in the top panel of the closure to define dispensing outlets.

Two distinct sets of locking surfaces are provided on the locking flap and the panel portion of the closure to secure the locking flap in its closed, folded position. More importantly, the provision of the two sets of cooperating latching surfaces requires the sequential and concurrent application of both a downward force to a selected position on the top panel of the closure plus a compression force exerted on a segment of the annular side wall of the closure underlying the free end of the locking flap. The downward force effects a pivoting of the free end portion of the locking flap upwardly, disengaging one set of locking surfaces, to permit the radial depression of the sidewall segment by a concurrent application of a compressive force. Such depression of a segment of the sidewall of the closure underlying the locking flap raises the locking flap and releases the second set of locking surfaces. The free end of the closure is then elevated slightly out of the panel recess, above the level of the top panel of the closure, in a position where it may be engaged by the fingers and lifted to a fully opened position.

A closure of this type may be fabricated by injection molding and, hence, represents an item that cam be economically produced at high speeds on a large multicavity injection molding machine. Since the combination of a downward force on a specific area of the top panel of the closure followed by the concurrent exertion of a compression force on the side wall of the closure is required to effect the initial opening of the locking flap, it is readily apparent that such sequential and concurrent action is beyond the capability of any child, but still well within the capability of a typical adult, including senior citizens. Under no circumstances can the opening of the closure be effected merely by banging the closure against a rigid object.

Other advantages of the invention will become apparent to those skilled in the art from the following detailed description, taken in conjunction with the annexed sheets of drawings on which are shown several modifications of this invention.

DESCRIPTION OF PREFERRED EMBODIMENT

Figure 1:
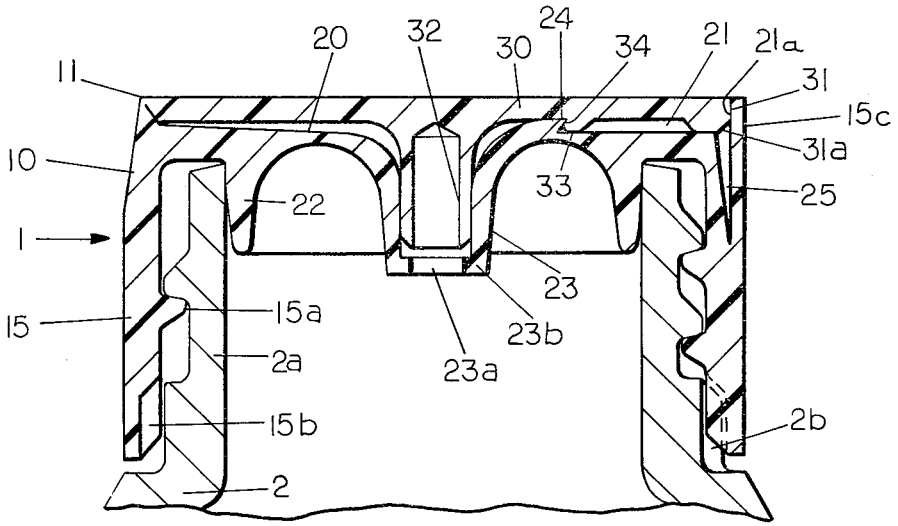
FIG. 1 is a vertical sectional view of a safety closure embodying this invention shown in assembled relationship to the neck of a container, with the integral locking flap of the closure being disposed in its locked position.

Referring to the drawings, the numeral 1 indicates generally a safety closure embodying this invention. Closure 1 comprises an inverted cup-shaped body portion 10 having a panel portion 20 and an integral annular depending wall 15. A locking flap 30 is integrally molded with body portion 10, being connected thereto by an integral hinge 11 located at a peripheral portion of the panel 20. The top surface of panel 20 is provided with a recess 21 which is proportioned to snugly receive the flap 30 therein when such flap is folded to the closed position of the closure indicated in FIG. 1. In such closed position of the loeking flap 30, the end face 31 of the locking flap is in snug engagement with the end wall 21*a* of the of the recess 21.

The annular wall 15 of the closure is provided with appropriate ribs or threads 15*a* on the internal surface for detachably mounting the closure 1 to the threaded neck 2*a* of a container 2. Additionally, a plurality of peripherally spaced serrations 15*b* are provided on the lower portion of the annular wall 15 to engage locking serrations 2*b* provided on the neck portion of the container 2.

Panel portion 20 is provided with a depending annular flange 22 which, in cooperation with the adjacent internal surface of the annular wall 15, defines a space to snugly receive the top end of the container neck 2*a* and effect a seal therewith. Panel 20 is additionally provided with a dispensing opening 23*a* defined by a depending annular protuberance 23 formed in the center of panel 20. The protuberance 23 has an internal end flange 23*b* for purpose to be hereafter described. Lastly, the panel recess 21 is provided with an upstanding locking shoulder 24 located on that side of the dispensing opening 23*a* opposite to the integral hinge 11.

Locking flap 30 is provided with an annular protuberance 32, which in the closed position of the locking flap, enters the opening defined by the annular protuberance 23 to effect a seal of the dispensing opening 23*a* and, equally importantly, it should be noted that the end surface of the locking flap protuberance 32 can move into abutting engagement with the internal flange 23*b*.

Locking flap 30 is additionally provided with a second depending member 33 which defines a hook surface 34 engageable with the upstanding locking projection 24 provided in the base of recess 21. Also, the free end portion of the locking flap 30 is somewhat enlarged in thickness and defines an inclined cam surface 31*a* beneath end surface 31 for a purpose hereafter to be described.

From the foregoing description, it will be noted that when the locking flap 30 is folded about the integral hinge 11 to lie in the closed position illustrated in FIG. 1, the protuberance 32 is in sealing engagement with the dispensing opening 23*a*, the second protuberance 33 defining the locking hook 34 is in latched engagement with the upstanding locking projection 24, and the end surface 31 of the locking flap is in abutment with the vertical end wall 31*a* of the panel recess 31.

Figure 3:
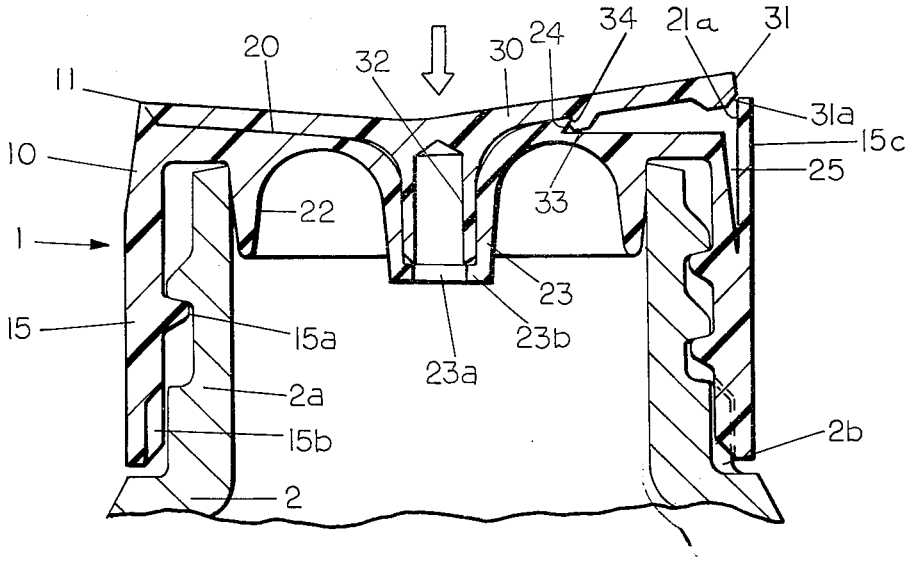
FIG. 3 is a view similar to FIG. 1 illustrating the positions of the closure components when a downward force is applied to the central portion of the locking flap.
Figure 2:
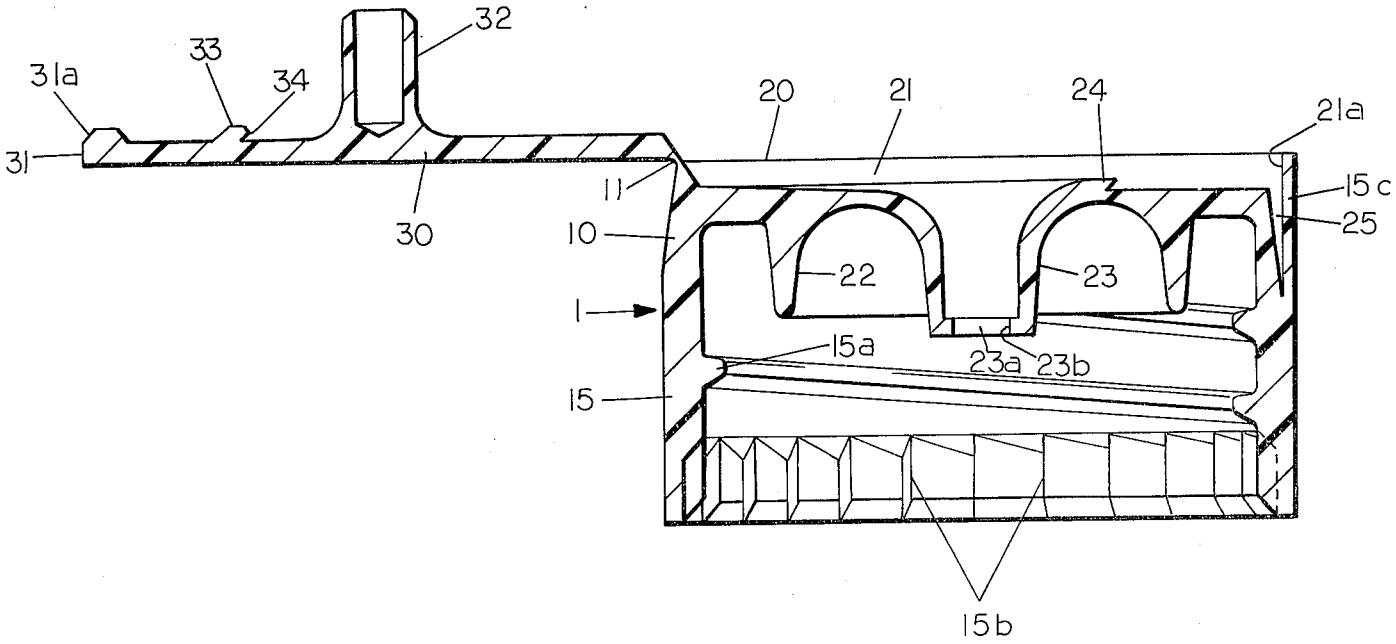
FIG. 2 is a vertical sectional view of the safety closure showing the closure components in their positions as molded in an injection mold.

To effect an opening of the closure, the sequential and concurrent application of two radically different forces to the closure assembly is required. First, a downward force has to be applied to the top central portion of the locking flap 30 immediately above the protuberance 32. This downward force not only depresses the center of the locking flap 30 but concurrently depresses the central portion of the panel 20 of the closure. The effect of this depression is illustrated in FIG. 3 where it is clear that the hook portion 34 of the locking flap 30 remains in locked engagement with the upstanding locking shoulder 24 provided in the recess 21; however, the free end surface 31 of the locking flap 30 is moved upwardly sufficient to bring the inclined cam surface 31*a* in position to be engaged by the end wall 31*a* of the recess, if such end wall is depressed inwardly.

Figure 4:
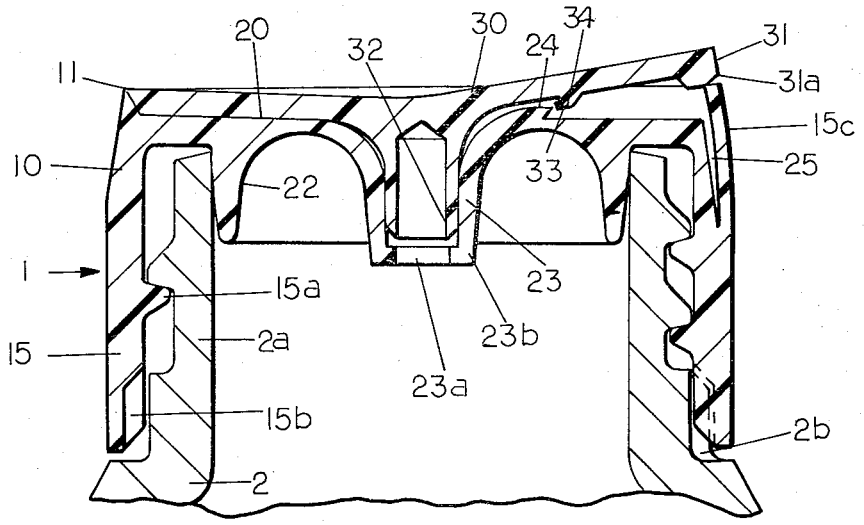
FIG. 4 is a view similar to FIG. 3 but illustrating the positions of the components of the closure when a compressing action on the sidewall of the closure is concurrently applied with the downward force.
Figure 5:
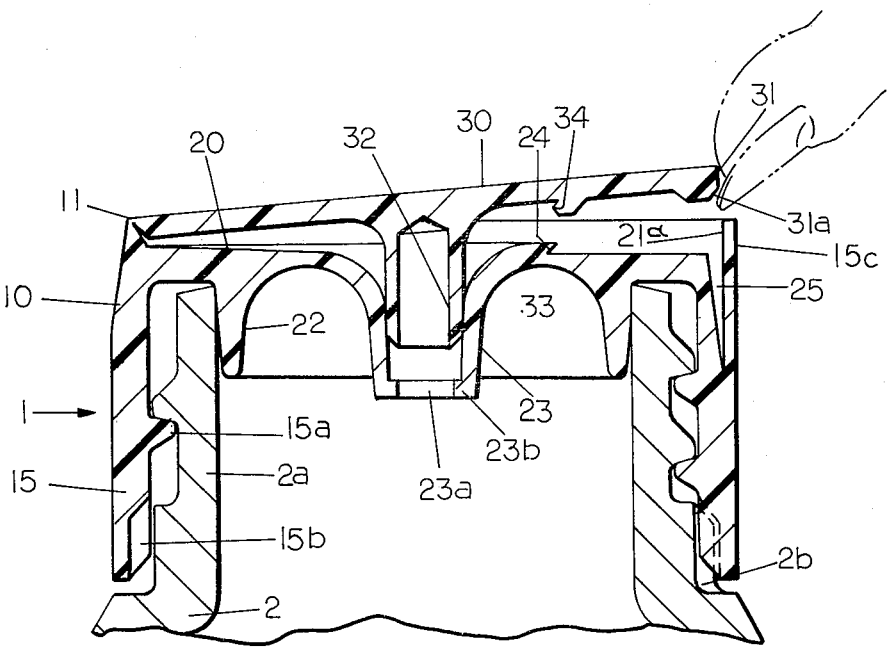
FIG. 5 illustrates the removal of the locking flap from its locking position by the fingernail of the manipulator.

In accordance with this invention, and open topped recess 25 is provided in a portion of the annular end wall 15 immediately underlying the free end of the locking flap 30. Such recess permits the surrounding wall portion 15*c* to be radially inwardly depressed through the application of compressing force by the fingers to the side wall segment. The effect of such radially inward movement of the side wall segment portion 15*c* is illustrated in FIG. 4 wherein it will be seen that the free end of the locking flap 30 is cammed upwardly sufficiently to release the depending locking hook 34 from the upstanding locking shoulder 24. The free end of the locking flap 30 can now be engaged by the fingernail (FIG. 5) and the locking flap elevated to its unlocked position, opening the dispensing aperture 23*a* to dispense the contents of the container 2 therethrough.

It is important to note that the sequential and concurrent application of the downward force to the central portion of the locking flap 30 and the compression force to the wall segment 15*c* is required to effect the opening of the locking flap 30. If only a downward force is applied, the depending locking hook 34 on the locking flap does not disengage from the upstanding locking shoulder 24 provided in the panel recess 31. As soon as the downward force is released, the locking flap 30 returns to its original position shown in FIG. 1. On the other hand, if only a compression force is applied to the side wall segment 15*c*, without the preceding and concurrent application of a downward force to the central portion of the locking flap 30, then no action results because radial inward movement of the side wall segment 15*c* is effectively blocked by the vertical end face 31 of the locking flap 30.

From the foregoing description, it will be apparent that a safety closure embodying this invention incorporates two distinct sets of cooperating locking surfaces for holding the locking flap in its closed locked position in the panel recess. The first set of such cooperating locking surfaces is the vertical end surface 31 of locking flap 30 which cooperates with the adjacent end wall 21*a* of the panel recess 21. The second set of locking surfaces comprises the upstanding member 24 defining the locking surface in the panel recess 21 and the depending hook member 34 formed on the locking flap 30. The first set of locking surfaces are disengageable by the application of a downward force to the central portion of the locking flap 30. Such downward movement, as explained above, does not effect the disengagement of the locking surface 24 with the locking hook 34. The locking hook 34 is then disengageable from the locking surface 24 by the concurrent inward depression of the wall segment 15*c* which lies adjacent the free end of the locking flap 30. Such inward depressing movement of the wall segment 15*c* effects an upward camming of the locking flap 30 to disengage the second set of locking surfaces, thereby freeing the locking flap 30 to be lifted by the finger to a fully opened position.

It will be obvious to those skilled in the art that the sequential and concurrent application of a downward force in a specific location with a compression force applied to another specific location on the side wall 15 is beyond the capability of any child, hence the safety closure embodying this invention provides an unusual degree of safety from inadvertent opening by a child, without in any manner interfering with the easy opening of the closure by an adult who follows the opening instructions.

Modifications of this invention will be readily apparent to those skilled in the art and it is intended that the scope of the invention be determined solely by the appended claims.

We claim:

1. A safety closure for a container neck comprising, in combination, (1) an inverted cup-shaped body member molded from a resilient plastic and having a circular top panel portion and an integral depending annular sidewall;

(2) means on said annular sidewall for securing the closure to a container neck;

(3) a locking flap connected by an integral hinge to a peripheral portion of said top panel portion;

(4) said top panel portion defining a recess corresponding in configuration and depth to said locking flap, whereby said locking flap may be folded about said integral hinge to lie in said recess with no edge portion of the locking flap projecting out of said recess and with the free end of the locking flap overlying a portion of said sidewall and abutting the radial end wall of said recess;

(5) means in the base of said recess defining a locking shoulder located on the side of the said dispensing opening remote from said hinge;

(6) a first depending protuberance on said locking flap defining a hook portion resiliently engageable with said locking shoulder to lock said locking flap within said recess;

(7) means in said recess defining a dispensing opening for the container contents;

(8) said locking flap having a second depending protuberance sealingly engaging said dispensing opening when said locking flap is folded into said recess, a portion of said protuberance having a solid engagement with the wall of said dispensing opening, whereby the application of a downward force to the portion of the locking flap over said second protuberance will displace the free end of the locking flap in an upward direction without releasing said hook portion from its locking engagement with said locking shoulder; and (9) said sidewall portion underlying the free end of said locking flap being inwardly deformable by finger compression to cam the free end of the locking flap upwardly out of said recess sufficient to release said hook portion from said locking shoulder and to permit it to be engaged by the fingers and lifted to an open position relative to said dispensing opening.

2. The safety closure of claim 1 wherein said dispensing opening is defined by a depending annular wall having an internal rib engageable by the end of said second protuberance.

3. A safety closure for a necked container comprising, in combination:

(1) an inverted cup-shaped body member molded from a resilient plastic and having a circular top panel portion and an integral depending annular sidewall;

(2) means on said annular side wall for securing the closure to a container neck;

(3) a locking flap connected by an integral hinge to a peripheral portion of said top panel portion;

(4) said top panel portion defining a recess corresponding in configuration and depth to said locking flap, whereby said locking flap may be folded about said integral hinge to lie snugly in said recess with no edge portion of the locking flap projecting out of said recess and with the free end of the locking flap overlying a portion of said annular side wall;

(5) means in said recess defining a dispensing opening for the container contents;

(6) said locking flap having a depending protuberance sealingly engaging said dispensing opening when said locking flap is folded into said recess; and (7) two sets of cooperating locking surfaces respectively provided on said panel portion and said locking flap, the first set being releasable by a downward pressure on a selected portion of said top panel and the second set of locking surfaces being releasable by a radial compression of that portion of said sidewall underlying the free end of the locking flap.

4. A safety closure in accordance with claim 3 wherein that portion of the side wall underlying the free end of the locking flap is provided with an upwardly open recess to facilitate the inward depression of said side wall portion.

* * * * *